US011864619B2

(12) United States Patent
Raia

(10) Patent No.: US 11,864,619 B2
(45) Date of Patent: Jan. 9, 2024

(54) SYSTEM FOR AUTOMATICALLY PUTTING ON/TAKING OFF A FOOTWEAR

(71) Applicants: Sorin Raia, Bucharest (RO); Behboud Madadi, Bucharest (RO)

(72) Inventor: Sorin Raia, Bucharest (RO)

( * ) Notice: Subject to any disclaimer, the term of this patent is extended or adjusted under 35 U.S.C. 154(b) by 480 days.

(21) Appl. No.: 17/250,726

(22) PCT Filed: Sep. 2, 2019

(86) PCT No.: PCT/RO2019/000017
§ 371 (c)(1),
(2) Date: Feb. 24, 2021

(87) PCT Pub. No.: WO2020/050734
PCT Pub. Date: Mar. 12, 2020

(65) Prior Publication Data

US 2021/0345727 A1 Nov. 11, 2021

(30) Foreign Application Priority Data

Sep. 5, 2018 (RO) ..... a 2018 00652

(51) Int. Cl.
*A43B 11/00* (2006.01)
*A43B 1/00* (2006.01)
(Continued)

(52) U.S. Cl.
CPC ..... *A43B 11/00* (2013.01); *A43B 1/0018* (2013.01); *A43B 13/182* (2013.01); *A43B 13/20* (2013.01)

(58) Field of Classification Search
CPC ..... A43B 11/00; A43B 1/0018; A43B 13/182; A43B 13/20
See application file for complete search history.

(56) References Cited

U.S. PATENT DOCUMENTS 3,517,866 A * 6/1970 Damerel ..... A47G 25/80 223/111
5,025,575 A * 6/1991 Lakic ..... A43B 17/08 36/44
(Continued)

FOREIGN PATENT DOCUMENTS

CN 87103983 A * 12/1988
CN 108420586 A * 8/2018 ..... A61F 5/0111
(Continued)

OTHER PUBLICATIONS

European Patent Office, International Search Report and Written Opinion dated Feb. 13, 2020 for PCT International Application No. PCT/RO2019/000017, International Filing Date Sep. 2, 2019, Priority Date Sep. 5, 2018.

*Primary Examiner* — Ismael Izaguirre
(74) *Attorney, Agent, or Firm* — Law Office of Andrei D Popovici, PC

(57) ABSTRACT

System for automatically putting on/taking off a footwear (S), comprising: a fixed inner sole (1), to support the front part of a user's sole; a movable inner sole (2), for supporting the rear part of the user's sole, connected to the fixed inner sole (1) and movable relative to the fixed inner sole (1) by means of a joint (3); a lower inflatable cushion (4) fixed to the movable inner sole (2), on a side of the movable inner sole (2) which is opposite to the one intended to come into contact with the rear part of the user's sole; where the lower inflatable cushion (4) has the capacity to store, through a supply/drain valve (5), a quantity of fluid under pressure. The fluid stored in the lower inflatable cushion (4) can also be partially or totally evacuated (4) by means of the valve (5); an upper inflatable cushion (6), intended to be fixed in an area and on a surface of the (S) footwear where the laces are usually placed; a flexible hose (7) that is non-deformable in terms of volume that permanently ensures fluid commu-
(Continued)

Figure 1:
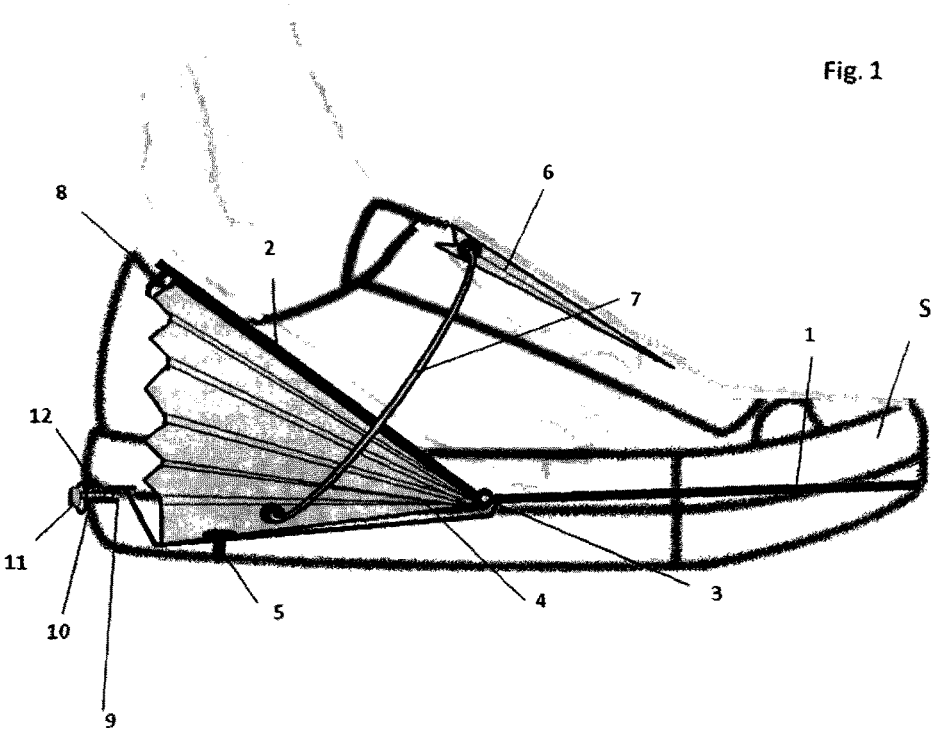

nication between the lower inflatable cushion (4) and the upper inflatable cushion (6); where the movable inner sole (2) is capable of moving between a first extreme position, in which the movable inner sole (2) compresses to a minimum the lower inflatable cushion (4), the lower inflatable cushion (4) having maximum volume and the upper inflatable cushion (6) having minimum volume implicitly, and a second extreme position, in which the movable inner sole (2) compresses to the maximum the lower inflatable cushion (4), the lower inflatable cushion (4) having minimum volume and the upper inflatable cushion (6) having maximum volume; the system additionally comprises a locking/unlocking assembly of the movable inner sole (2) in/from the second extreme position.

7 Claims, 4 Drawing Sheets

(51) Int. Cl.
*A43B 13/18* (2006.01)
*A43B 13/20* (2006.01)

(56) References Cited

U.S. PATENT DOCUMENTS

| | | | | |
|---|---|---|---|---|
| 5,113,599 | A | 5/1992 | Cohen et al. | |
| 5,655,315 | A * | 8/1997 | Mershon | A43B 13/206 36/35 B |
| 6,378,230 | B1 | 4/2002 | Rotem et al. | |
| 6,427,361 | B1 * | 8/2002 | Chou | A43C 11/008 36/138 |
| 7,059,069 | B2 | 6/2006 | Raluy et al. | |
| 8,522,456 | B2 | 9/2013 | Beers et al. | |
| 2005/0198867 | A1 | 9/2005 | Labbe | |
| 2006/0272179 | A1 | 12/2006 | Passke et al. | |
| 2016/0374427 | A1 * | 12/2016 | Zahabian | A43B 3/24 36/102 |

FOREIGN PATENT DOCUMENTS

| | | | |
|---|---|---|---|
| JP | 10262706 | A * | 10/1998 |
| RO | 120882 | B1 | 9/2006 |
| WO | 8909552 | | 10/1989 |
| WO | 2017188833 | A1 | 11/2017 |

* cited by examiner

SYSTEM FOR AUTOMATICALLY PUTTING ON/TAKING OFF A FOOTWEAR

The invention relates to a system for automatically putting on/taking off a footwear.

The footwear means any type of footwear, such as, for example, a regular shoe, a sports shoe, a protective shoe, etc.

Several documents are known, including U.S. Pat. Nos. 7,059,069B2, 8,522,456B2 and 6,378,230B1, which refer to different devices and mechanisms for automatically attaching a footwear, but they require a very complex manufacturing process, containing many elements and subassemblies that that decrease the reliability of the product, appearing the risk of their failure and furthermore, their manufacturing cost can lead to a sale price far too high for most potential customers through the need to use different materials and the multitude of moulds needed for casting, placing this approach in a prohibitive acquisition area due to the price.

Document US20050198867A1 describes a mechanism for automatically closing a footwear, which also uses elements that may be damaged. In addition, the locking/unlocking mechanism is quite difficult to access for the user, for whom it is difficult to bend or needs help from other people (for example, children or people with disabilities).

Document U.S. Pat. No. 5,113,599 describes a mechanism that uses air to inflate parts of the footwear by using an air pump, but which requires action by a person with the help of the hands for both swelling and deflation, an action that is difficult for people who have full hands or have difficulty in bending or handling such a system (for example, children or persons with disabilities).

The disadvantages of the technical solutions from the prior art, corresponding to the documents listed above, consist of:

- relatively difficult operation, which counterbalances the advantage of automatically putting on/taking off the footwear;
- low reliability;
- the footwear acquires an unnatural appearance due to the insertion of complex elements and mechanisms;
- the mechanisms and materials used are very complex, requiring high design and manufacturing costs.

Document WO/2017/188833, whose applicant-inventor is identical to that of the present patent application, discloses an example of the execution of a footwear provided with a system for automatically putting on/taking off the footwear, which partially resolves the abovementioned disadvantages, in the sense that the operation of the system is simple, it is provided exclusively by actuation with the sole of the user's foot, the reliability is increased and the outer appearance of the footwear remains unchanged.

The solution according to WO/2017/188833 discloses a system for automatically putting on/taking off a footwear that includes:

- a lower inflatable cushion, capable of storing air under pressure, fixed inside the footwear in the area of the rear part of the user's sole;
- an upper inflatable structure fixed in an area of the footwear where the laces are usually placed;
- a flexible hose provided with a one-way valve (with the direction from the lower inflatable cushion to the upper inflatable structure), the flexible hose ensuring fluid communication between the lower inflatable cushion and the upper inflatable structure;
- a jointed plate at the sole of the footwear, which, when actuated by the user's heel, compresses the lower inflatable cushion, causing the air from the lower inflatable cushion to enter the upper inflatable structure, increasing its internal pressure and volume, and consequently to press on the user's foot, thus fixing it in the footwear;
- a lever actionable by means of a button, which unlocks the one-way valve and allows air from the upper inflatable structure to return to the lower inflatable cushion, thus allowing the release of the user's foot.

Although it provides reliability and ease of operation, the solution according to WO/2017/188833 nevertheless faces disadvantages, such as the relatively high complexity of the system (due to the presence of the one-way valve and the lever unblocking it, which implies technical difficulties to achieve) and relatively high manufacturing costs.

The technical problem that the present invention solves is the creation of a system for automatically putting on/tacking off a footwear that has a simple, reliable, easy to make and cheap construction.

The system according to the invention, for automatically putting on/taking off a footwear, comprises:

- a fixed inner sole, to support the front part of a user's sole;
- a movable inner sole, to support the rear part of the user's sole, connected to the fixed and movable inner sole relative to the fixed inner sole through a joint;
- a lower inflatable cushion fixed to the movable inner sole, on a side of the movable inner sole which is opposite to the one intended to come into contact with the rear part of the user's sole;
  - where the lower inflatable cushion has the capacity to store, through a supply/drain valve, a quantity of fluid under pressure. The fluid stored in the lower inflatable cushion can also be partially or completely evacuated through the same valve;
- an upper inflatable cushion, intended to be fixed in an area and on a surface of the footwear where the laces are usually placed;
- a flexible hose that is non-deformable in terms of volume that permanently ensures fluid communication between the lower inflatable cushion and the upper inflatable cushion;
  - where the movable inner sole is capable of moving between
    - a first extreme position, in which the movable inner sole compresses to a minimum the lower inflatable cushion, the lower inflatable cushion having maximum volume and the upper inflatable cushion having minimum volume implicitly, and
    - a second extreme position, in which the movable inner sole compresses to the maximum the lower inflatable cushion, the lower inflatable cushion having minimum volume and the upper inflatable cushion having maximum volume;
- an assembly for locking/unlocking the movable inner sole in/from the second extreme position.

The said fluid may be a gas (for example, air) or a liquid (for example, water).

A flexible hose that is non-deformable in terms of volume means that the inner volume of the flexible hose remains substantially constant when a fluid transfer occurs between the two inflatable cushions. Since the hose is flexible, it is obvious that its outward appearance may vary (for example, it may take the form of a circular arc with a larger or smaller radius).

The system according to the invention has the following advantages:

- it is simple, easy to make and cheap;

the operation of the system is done without the user bending and without using his/her hands;

high reliability and service life;

does not alter the outer appearance of the footwear.

Figure 2:
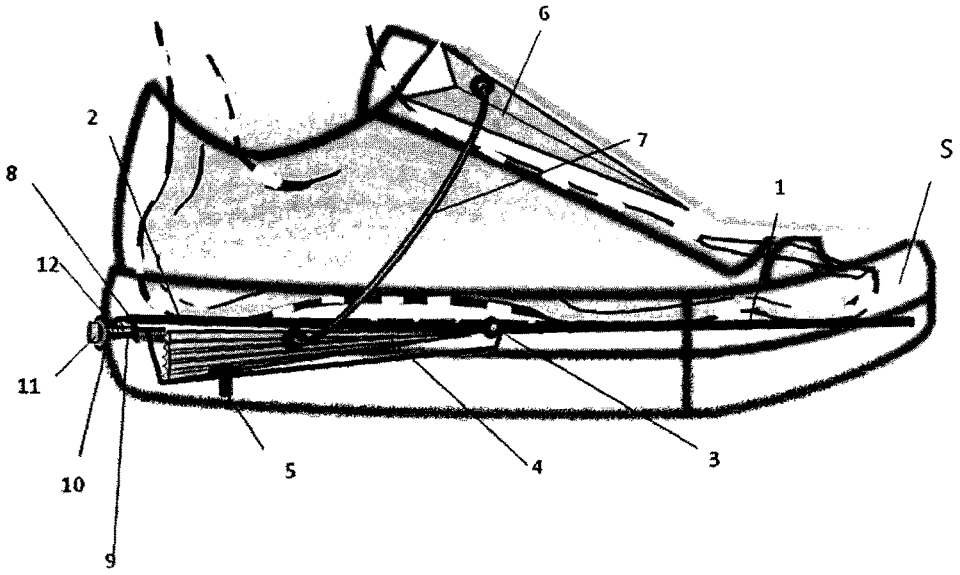
Figure 3A:
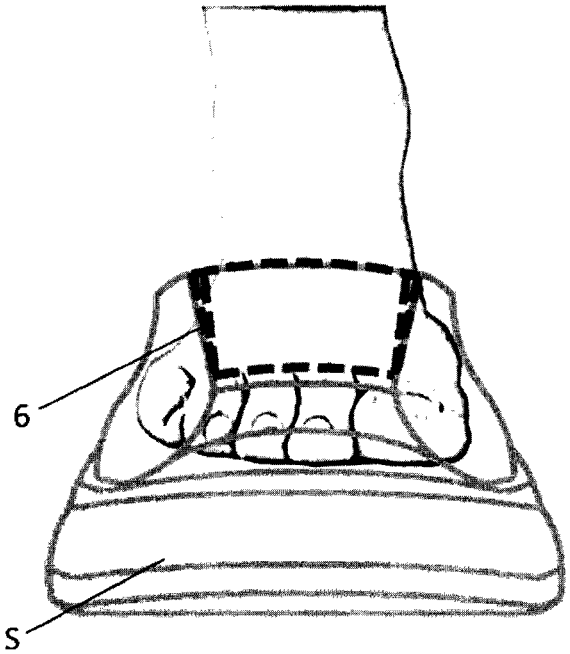
Figure 3B:
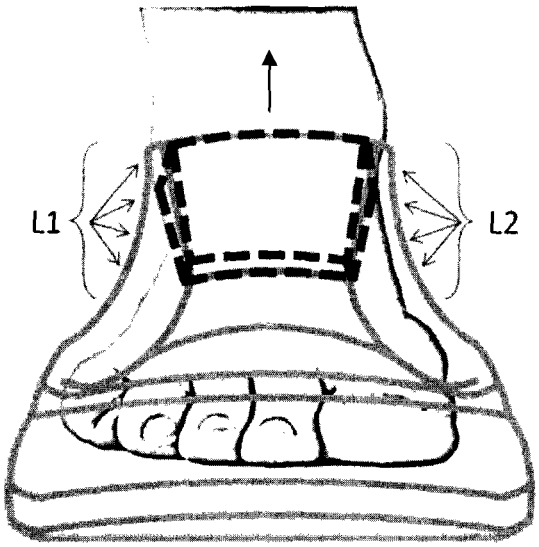
Figure 5A:
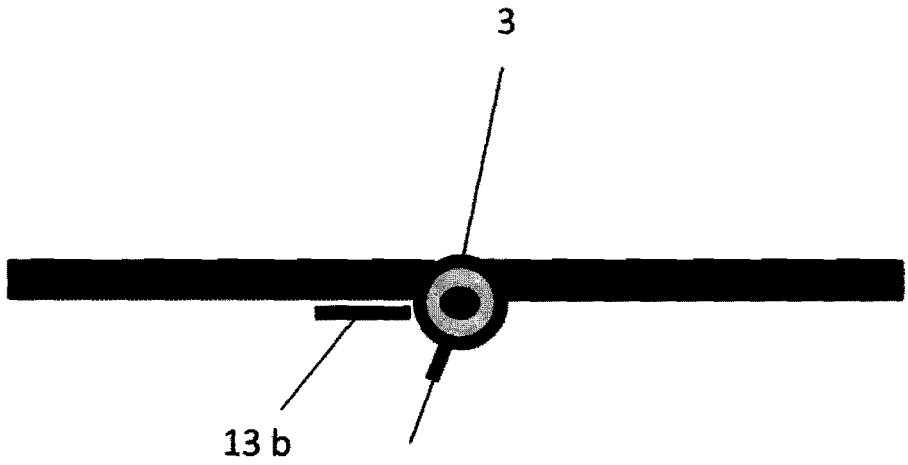
Figure 5B:
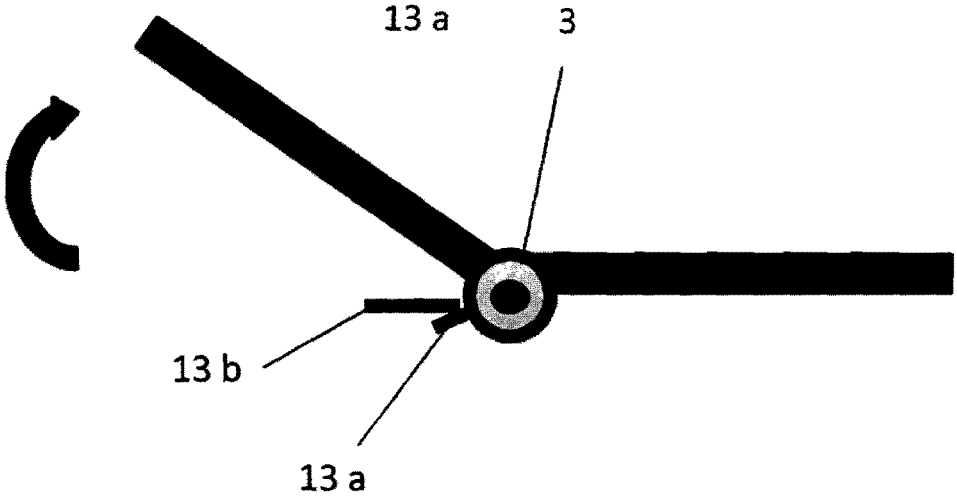

The following is an example of the development, without limitation, of a system for automatically putting on/taking off a footwear according to the invention and which is in relation to FIGS. 1-5, which represent:

FIG. 1: system according to the invention, applied to a footwear, in a position where the user's foot is free;

FIG. 2: system according to the invention, applied to a footwear, in a position in which the user's foot is fixed, by means of the respective system, inside the footwear;

FIG. 3*a*-3*b*: front view of the system according to the invention, corresponding to FIG. 1 and respectively FIG. 2;

FIG. 4*a*-4*d*: details of the locking/unlocking assembly of the movable inner sole;

FIG. 5*a*-5*b*: illustration of the locking mode of the movable inner sole in the first extreme position.

FIG. 1 shows a system according to the invention, applied to an S footwear, system comprising:

- a fixed inner sole 1, to support the front part of the user's sole. The fixed inner sole 1 is intended to be fixed to or supported by the inner surface of the sole of the S footwear;
- a movable inner sole 2, for supporting the rear part of the user's sole, connected to the fixed inner sole 1 and movable inner sole relative to the fixed inner sole 1 through a joint 3;
- a lower inflatable cushion 4 fixed to the movable inner sole 2, on a side of the movable inner sole 2 which is opposite to the one intended to come into contact with the rear part of the user's sole, where the lower inflatable cushion 4 is provided with a supply/drain valve 5, through by means of which a quantity of fluid may be stored under pressure or the stored fluid may be partially or totally in the lower inflatable cushion 4;
- an upper inflatable cushion 6, intended to be fixed in an area and on a surface of the S footwear where the laces are usually placed;
- a flexible hose 7 that is non-deformable in terms of volume that permanently ensures fluid communication between the lower inflatable cushion 4 and the upper inflatable cushion 6.

The movable inner sole 2 is able to move, through the joint 3, between a first extreme position and a second extreme position.

In FIG. 1, the movable inner sole 2 is in the first extreme position, when it compresses to the minimum the lower inflatable cushion 4, the lower inflatable cushion 4 has maximum volume, almost the whole amount of fluid is in the lower inflatable cushion 4 and the upper inflatable cushion 6 has a default minimum volume. When the user puts on the S footwear, he/she presses progressively with the heel on the movable inner sole 2 and implicitly on the lower inflatable cushion 4 until the movable inner sole 2 reaches the second extreme position illustrated in FIG. 2, where the movable inner sole 2 compresses to maximum the lower inflatable cushion 4, the lower inflatable cushion 4 has a minimum volume, almost the entire amount of fluid is in the upper inflatable cushion 6 and the upper inflatable cushion 6 has a default maximum volume.

Due to the increase in volume, the upper inflatable cushion 6 will generate a pressing force on the upper surface of the front part of the user's foot, thus causing the foot to be fixed in the S footwear.

Preferably, the ratio between the maximum and the minimum volume of the upper inflatable cushion 6 is at least 2. This ratio allows, on the one hand, that when the volume of the upper inflatable cushion 6 is minimal, to provide sufficient space for the foot to be inserted into the S footwear, and on the other hand, when the volume of the upper inflatable cushion 6 is maximum, to provide an effective fixation of the foot in the S footwear and not to alter the outer appearance of the latter.

It is known that after a longer wearing of a footwear, the feet may swell, and a fixation of the foot with the help of other rigid systems would adversely affect the blood circulation in the foot.

The system according to the invention totally eliminates this disadvantage by fixing the foot with the help of the upper inflatable cushion 6, which presses the foot on a relatively large surface, which causes the pressing force not to acquire excessive values, and the blood circulation at the foot remains at normal parameters.

Considering that each user has a certain type of foot anatomy, both in terms of the width of the sole and the height of the foot, through the supply/drain valve 5, the volume and pressure of the fluid in the circuit can be adjusted, so that if a more consistent tightening is needed, fluid can be added, and if the tightening is too consistent, fluid can be removed. Also, depending on the activities performed by the person using the system, he/she can adjust for example the pressure (tightening) for the running activity in the same way, by adding fluid through the supply/drain valve 5, or if he/she wants the footwear to be lighter, for a walk for example, he/she can remove fluid through the same process.

The upper inflatable cushion 6 can be housed, for example, in a special chamber provided in the inside of the S footwear. In order to maximise the pressing force on the user's foot, it is necessary that, when it increases in volume, the upper inflatable cushion 6 moves mainly towards the interior of the S footwear.

For this purpose, the special chamber mentioned inside the S footwear can, for example, be constructed so that its upper and lateral walls are more rigid (less deformable) and the lower wall is more elastic/flexible. The wall at the top of the special chamber is also in direct contact with the upper part of the S footwear.

Thus, when the upper inflatable cushion 6 has maximum volume, it exerts pressure on both the user's foot and the wall at the top of the special chamber, causing the upper part of the S footwear to move slightly upwards (in the direction of the vertical arrows in FIG. 3*b*), thus causing the lateral parts of the S footwear to be tightened on the user's foot (in the direction of the arrows in the lateral parts of FIG. 3*b*), providing an additional fixation of the foot in the S footwear.

The process described in the previous paragraph is illustrated in FIGS. 3*a* and 3*b*.

FIG. 3*a* shows schematically, in front view, the S footwear provided with the upper inflatable cushion 6 when it has the minimum volume, as well as the foot of the user who is preparing to put on the S footwear.

FIG. 3*b* shows schematically the S footwear, completely put on the user's foot. In this position, the upper inflatable cushion 6 has the maximum volume, exerting pressure on both the user's foot and the wall at the top of the special chamber, causing the upper part of the S footwear to move slightly upwards and the lateral parts L1 and L2 of the S footwear thus tightening, in the direction of the arrows, on the user's foot, providing an additional fixation of the foot in the S footwear.

After putting on the footwear, the foot never remains absolutely fixed, being able to move within certain limits inside the S footwear. During walking, but especially during running, the user's heel can be lifted, thus releasing the movable inner sole 2, and thus allowing the pressure to decrease in the lower and upper inflatable cushions 4 and 6, thus lowering the pressing force of the upper inflatable cushion 6 on the foot.

To eliminate this disadvantage, the system according to the invention further comprises a locking/unlocking assembly of the movable inner sole 2 in/from the second extreme position.

By locking the movable inner sole 2 in the second extreme position, even if the user lifts the heel from the movable inner sole 2, the lower inflatable cushion 4 retains its minimum volume, there is no fluid transfer, the pressure from the upper inflatable cushion 6 will remain constant, the upper inflatable cushion 6 retains its maximum volume, and the pressing force on the user's foot will also remain constant.

The locking/unlocking assembly can be designed in various ways. The example of achievement shown in the following is a non-exhaustive one.

The assembly according to the invention is one with automatic locking and unlocking by action by the user.

The locking/unlocking assembly according to the invention, illustrated in detail in FIGS. 4*a*-4*d*, comprises:

- a flexible brake 8 fixed at one end of the movable inner sole 2 which is opposite to the joint 3, where the flexible brake 8 is made from a single piece and comprises:
  - a first flat area 8*a* provided with a perforation P;
  - a second flat area 8*b*, substantially coplanar with the first area 8*a*, arranged laterally and in the extension of the first area 8*a;*
  - a third flat area 8*c* arranged at the bottom and in the extension of the first area 8*a*, where the plan of the third area 8*c* forms with the plan of the first area 8*a* an angle between 10°-45°, so that the third flat area 8*c* is oriented towards the lower inflatable cushion 4;
- a means for locking/unlocking the flexible break 8, fixed to the S footwear in the user's heel area, and which includes:
  - a locking lever 9, fixed in relation to the S footwear, and having the shape of an elongated element that is dimensioned so that:
    - it can slide on the third flat area 8*c*, thus pushing the entire flexible brake 8 in the direction of the lower inflatable cushion 4 when the movable inner sole 2 reaches in the immediate vicinity of the second extreme position,
    - and then be able to penetrate through the perforation P when the movable inner sole 2 reaches the second extreme position;
  - an unlocking pin 10 provided at one of its ends with a button 11 and subjected to the action of a helical spring 12, the pin 10 being able to adopt
    - a retracted position, in which the spring 12 is tensioned to a minimum and the pin 10 is not in contact with any surface of the flexible brake 8; and
    - an advanced position, in which the spring 12 is fully tensioned by pressing the button 11 and the pin 10 is in contact and presses on the second surface 8*b* of the flexible brake 8 and pushes the flexible brake 8 until the locking lever 9 exits from the perforation P, thus releasing the flexible brake 8 together with the movable inner sole 2.

Figure 4A:
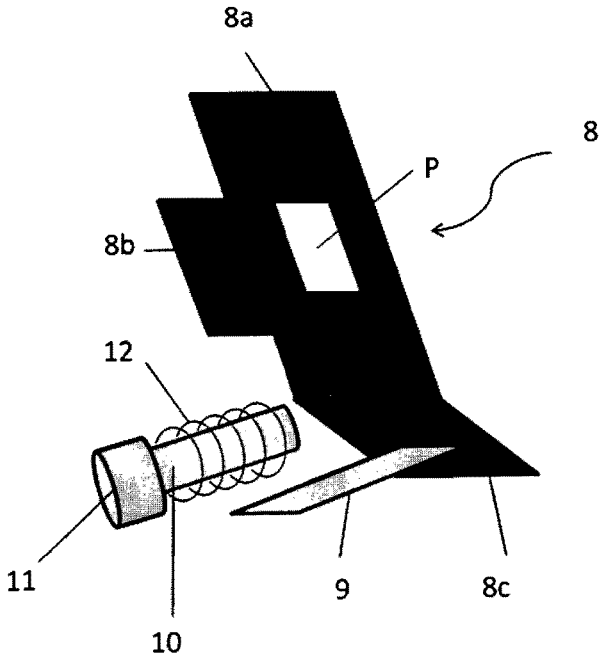
Figure 4B:
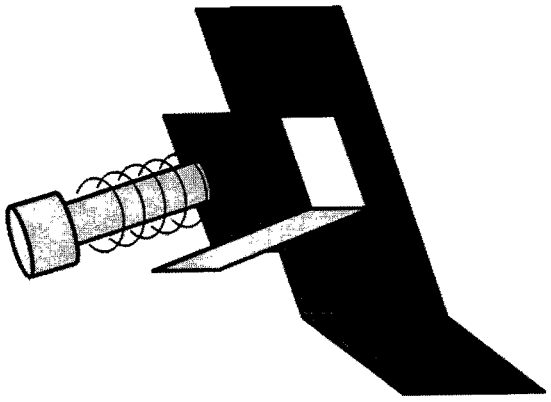
Figure 4C:
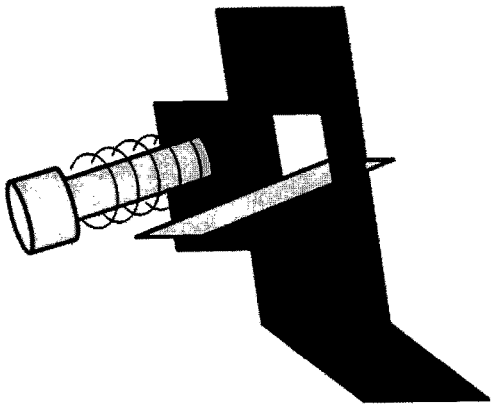
Figure 4D:
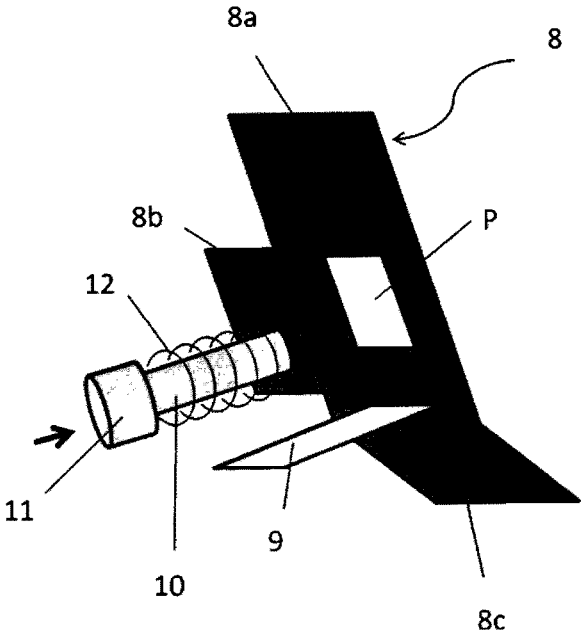

The locking/unlocking assembly works in the following way: when the user begins to put on the S footwear, he/she press the heel on the movable inner sole 2. The movable inner sole 2, together with the flexible brake 8 fixed to it, begins to descend towards the sole of the S footwear. Near the second extreme position, the third flat area 8*c* of the flexible break 8 comes in contact with and slides on the end of the locking lever 9 (FIG. 4*a*). Then, as the flexible brake 8 continues to descend, it is the turn of the first flat area 8*a* of the flexible brake 8 to come in contact with and slide on the end of the locking lever 9 (FIG. 4*b*). Then, as the flexible brake 8 continues to descend, the end of the locking lever 9 will penetrate at one point through the hole P in the flat area 8*a* of the flexible brake 8 (FIG. 4*c*). The third area 8*c*, due to the fact that it forms with the plan of the first area 8*a* an angle between 10°-45° and is oriented towards the lower inflatable cushion 4, ensures the sliding of the flexible brake 8 on the locking lever 9 until the moment the end of the locking lever 9 is penetrated in hole P.

All this time, under the action of the elastic force of the spring 12, the pin 10 is kept at a distance from the flexible brake 8.

In the absence of the third flat area 8*c*, the locking lever 9 would act as a stop for the first flat area 8*a*, preventing its complete movement and consequently the locking lever 9 could no longer enter the hole P.

When the user wants to take off the footwear, he/she first lifts the foot off the ground, then touches the other foot with the back of the S footwear, thus pressing the button 11. By pressing the button 11, the elastic force of the spring 12 is defeated, causing the pin 10 to come into contact and to press on the second flat area 8*b* of the flexible break 8, pushing the whole flexible break 8 in the direction of the lower inflatable cushion 4, until the locking lever 9 exits the perforation P, thus releasing the flexible break 8 together with the movable inner sole 2 (FIG. 4*d*), the movable inner sole 2 together with the flexible break 8 being pushed upwards by the pressure of the fluid from the lower cushion 4, which means that the shoe is taken off virtually automatically.

In order that the movable inner sole 2 does not exceed the first extreme position, the system is additionally provided with a protrusion 13*a* fixed to the joint 3 and capable of rotating in solidarity with the joint 3 and the movable inner sole 2, as well as with a stop 13*b* fixed to the sole of the S footwear, so that when the mobile inner sole 2 reaches the first extreme position, the protrusion 13*a* comes in contact with and is locked together with the movable inner sole 2, by the stop 13*b*.

FIG. 5*a* shows schematically the movable inner sole 2 in the second extreme position, in which the protrusion 13*a* and the stop 13*b* are not in contact.

FIG. 5*b* shows schematically the movable inner sole 2 in the first extreme position, in which it is observed that the protrusion 13*a* is in contact with the stop 13*b*, thus blocking the additional rotation of the joint 3 and implicitly of the movable inner sole 2.

The flexible hose 7 is made of a suitable material and is dimensioned so that the volume of the flexible hose 7 remains substantially constant when a fluid transfer occurs between the two inflatable cushions 4, 6. If the volume of the hose would vary depending on the pressure inside it, then there would be a possibility that the pressure inside the upper inflatable cushion 6 would be insufficient for fixing the user's foot in the S footwear.

As mentioned above in the description, the lower inflatable cushion 4 is permanently in fluid communication with the upper inflatable cushion 6 through the flexible hose 7. As a result, we basically have a single complex enclosure made up of the two inflatable cushions 4, 6 and the flexible hose 7, and consequently, for any given time, there will be the same amount corresponding to the pressure in each of the lower inflatable cushions 4, upper inflatable cushion 6 and flexible hose 7.

The materials from which the two inflatable cushions 4, 6 are manufactured, as well as the pressure from the two inflatable cushions 4, 6, when the movable inner sole 2 is in the first extreme position, are selected so that the ratio between the maximum volume and the minimum volume of the upper inflatable cushion 6 has at least the value 2.

The pressure in the two inflatable cushions 4, 6 when the movable inner sole 2 is in the first extreme position is at least 1 atm.

The effect of these characteristics determines the optimal fixation (the foot is neither too free nor uncomfortable to tighten). The optimal fixation is determined on a case-by-case basis, depending on the destination of the shoe—for example, a regular shoe requires a moderate tightening, while a sports shoe requires a stronger tightening.

The invention claimed is:

1. System for automatically putting on/taking off a footwear (S), comprising:

a fixed inner sole (1), to support the front part of a user's sole;

a movable inner sole (2), for supporting the rear part of the user's sole, connected to the fixed inner sole (1) and movable relative to the fixed inner sole (1) by means of a joint (3);

a lower inflatable cushion (4) fixed to the movable inner sole (2), on a side of the movable inner sole (2) which is opposite to the one intended to come into contact with the rear part of the user's sole;

where the lower inflatable cushion (4) has the capacity to store, through a supply/drain valve (5), a quantity of fluid under pressure, The fluid stored in the lower inflatable cushion (4) can also be partially or totally evacuated (4) by means of the valve (5);

an upper inflatable cushion (6), intended to be fixed in an area and on a surface of the (S) footwear where the laces are usually placed;

a flexible hose (7) that is non-deformable in terms of volume that permanently ensures fluid communication between the lower inflatable cushion (4) and the upper inflatable cushion (6);

where the movable inner sole (2) is capable of moving between a first extreme position, in which the movable inner sole (2) compresses to a minimum the lower inflatable cushion (4), the lower inflatable cushion (4) having maximum volume and the upper inflatable cushion (6) having minimum volume implicitly, and a second extreme position, in which the movable inner sole (2) compresses to the maximum the lower inflatable cushion (4), the lower inflatable cushion (4) having minimum volume and the upper inflatable cushion (6) having maximum volume;

a locking/unlocking assembly of the movable inner sole (2) in/from the second extreme position;

characterised in that the locking/unlocking assembly is composed of:

a flexible break (8) fixed to one end of the movable inner sole (2) which is opposite to the joint (3), where the flexible brake (8) is made from a single piece and comprises:

a first flat area (8*a*) provided with a perforation (P);

a second flat area (8*b*), substantially coplanar with the first area (8*a*), arranged laterally and in the extension of the first area (8*a*);

a third flat area (8*c*) arranged at the bottom and in the extension of the first area (8*a*), where the plan of the third area (8*c*) forms with the plan of the first area (8*a*) an angle between 10°-45°, so that the third flat area (8*c*) is oriented towards the lower inflatable cushion (4);

a means for locking/unlocking the flexible break (8), fixed to the (S) footwear in the user's heel area, and which includes:

a locking lever (9), fixed in relation to the (S) footwear, and having the shape of an elongated element that is dimensioned so that it can slide on the third flat area (8*c*), thus pushing the entire flexible brake (8) in the direction of the lower inflatable cushion (4) when the movable inner sole (2) reaches in the immediate vicinity of the second extreme position, and then be able to penetrate through the perforation (P) when the movable inner sole (2) reaches the second extreme position;

an unlocking pin (10) provided at one of its ends with a button (11) and subjected to the action of a helical spring (12), the pin (10) being able to adopt a retracted position, in which the spring (12) is tensioned to a minimum and the pin (10) is not in contact with any surface (8*a*, 8*b*, 8*c*) of the flexible brake (8);

an advanced position, in which the spring (12) is fully tensioned by pressing the button (11) and the pin (10) is in contact and presses on the second surface (8*b*) of the flexible brake (8) and pushes the flexible brake (8) until the locking lever (9) exits from the perforation (P), thus releasing the flexible brake (8) together with the movable inner sole (2).

2. System according to claim 1, characterised in that it is further provided with:

a protrusion (13*a*) fixed to the joint (3) and capable of rotating in solidarity with the joint (3) and the movable inner sole (2);

a stop (13*b*) fixed to the sole of the footwear (S);

so that when the mobile inner sole (2) reaches the first extreme position, the protrusion (13*a*) comes in contact with and is locked together with the movable inner sole (2), by the stop (13*b*).

3. System according to claim 1, characterised in that the flexible hose (7) is made of a suitable material and is dimensioned so that the volume of the flexible hose (7) remains substantially constant when a fluid transfer occurs between the two inflatable cushions (4, 6).

4. System according to claim 1, characterised in that the materials of which the two inflatable cushions (4, 6) are manufactured, as well as the pressure of the two inflatable cushions (4, 6) when the movable inner sole (2) is in the first extreme position, are selected so that the volume of the upper inflatable cushion (6) when the movable inner sole (2) is in the second extreme position has a value approximately two times higher than when the movable inner sole (2) is in the first extreme position.

5. System according to claim 4, characterised in that the pressure in the two inflatable cushions (4, 6) when the movable inner sole (2) is in the first extreme position is at least 1 atm.

6. System according to claim 1, characterised in that the upper inflatable cushion (6) is housed in a chamber provided inside the footwear (S), said chamber being provided with lateral walls, with an upper wall and a lower wall, the lateral and upper walls being more rigid, and the lower wall being more flexible, the upper wall of the chamber being in direct contact with the upper part of the footwear (S).

7. Footwear (S) provided with a system according to claim 1.

* * * * *